United States Patent [19]

Ullman

[11] Patent Number: 4,711,360

[45] Date of Patent: Dec. 8, 1987

[54] SPLASH-PROOF CLOSURE

[75] Inventor: Myron Ullman, Canfield, Ohio

[73] Assignee: Boardman Molded Products, Inc., Youngstown, Ohio

[21] Appl. No.: 22,927

[22] Filed: Feb. 26, 1987

[51] Int. Cl.[4] ..... B65D 43/16

[52] U.S. Cl. ..... 215/235; 220/335; 222/517; 222/546

[58] Field of Search ..... 220/335, 339; 215/235, 215/238, 237; 222/498, 517, 543, 546, 515

[56] References Cited

U.S. PATENT DOCUMENTS

| | | | |
|---|---|---|---|
| 4,010,875 | 3/1977 | Babiol | 222/517 |
| 4,158,902 | 6/1979 | Chernack et al. | 220/335 |
| 4,220,248 | 9/1980 | Wilson et al. | 215/235 |
| 4,346,810 | 8/1982 | Kneissl | 220/335 |
| 4,386,714 | 6/1983 | Roberto et al. | 220/335 |
| 4,625,898 | 12/1986 | Hazard | 222/517 |

*Primary Examiner*—George T. Hall

*Attorney, Agent, or Firm*—Browdy and Neimark

[57] ABSTRACT

A splash-proof closure for use with liquid holding containers is a one-piece molded structure and includes a body portion with a cap portion, and a hinge integrally formed therebetween. The body portion includes a liquid outlet and a vertically, integrally formed, upwardly extending cap-stopping resilient post for preventing the cap portion from moving towards the liquid outlet during the dispensing mode. The cap portion includes a somewhat domed upper wall which acts as a cam for bending the cap-stopping post at a 45° angle to the body portion when the cap portion is closed, and a closing post integrally formed on the domed wall interior for sealing the liquid outlet when the cap portion is closed on the body portion. The liquid outlet, the cap-stopping post, the closing post and the hinge are all generally along the same line, perpendicular to the hinge axis.

8 Claims, 6 Drawing Figures

SPLASH-PROOF CLOSURE

FIELD OF THE INVENTION

The present invention relates to one-piece molded plastic dispensing closures for use in conjunction with liquid holding containers, more particularly to closures of the splash-proof type, especially effective in the dispensing of viscous liquids.

BACKGROUND OF THE INVENTION

Containers for viscous liquids such as detergents, shampoo, lotions, baby oil, etc., are well known and often have closures including a body portion (having a dispensing aperture) for positioning on or around the container head or neck (defining the container opening) such as via screw threads, and an integrally hinged cap portion for closing or sealing the dispensing aperture in the body portion. Frequently, the cap in its open position may have a tendency to move towards or block the dispensing aperture during the dispensing mode of the viscous liquid, thereby causing splashing of the dispensed liquid against the cap. Results include loss of liquid, splashing of the liquid onto clothes, floors and other undesirable places as well as generally causing messy conditions, as well as clogging of the dispensing aperture.

Many closures of this general type are provided with splash-proofing means for preventing the cap portion from blocking the dispensing aperture. It has been known from the patent literature over the years to equip the closure body portion with an integrally formed, generally vertically erect protrusion or cap guide to prevent movement of the cap towards the dispensing aperture during the dispensing of liquids held within the container. For example, U.S. Pat. No. 3,752,371 to Susuki et al; U.S. Pat. No. 3,853,250 to Alpern; U.S. Pat. No. 4,010,875 to Babiol; U.S. Pat. No. 4,158,902 to Chernack et al; U.S. Pat. No. 4,193,519 to Dubach et al; and U.S. Pat. No. 4,220,248 to Wilson et al all disclose closures including splash-proofing means for preventing the cap, when open, from moving towards the dispensing aperture or other discharge opening of the container. While all of these above-mentioned patents disclose closures of the splash-proof type, all suffer from at least one of a variety of deficiencies and for the most part these prior constructions have not been successful.

For example, the constructions of the aforementioned patents are unduly complex, being difficult to mold especially as a one-piece structure, and are accordingly expensive to manufacture. Injection molding, the process by which closures of this type are commonly formed, is very sensitive to processing economics. The molds used may have 48, 60, 72, 96, etc. cavities, and the molding must be carried out at high speed. If the cavities take excess space because of complexities of the shape of the cap, this means that the molds are more expensive to manufacture, slower to operate with increased cycle time, and more floor space is necessary, all of these factors increasing the cost of manufacture of the closure and the ultimate cost of the product. If the closure is particularly complex, it may require molding in two or more pieces with a consequent and extra assembly operation at the conclusion of molding. All these factors add to the cost, and all the structures of the aforementioned patents suffer from this problem.

Thus, the closure of Dubach U.S. Pat. No. 4,193,519 requires two levers or protrusions. In order to mold this device an undercut is required in one of the levers which increases the cost of the mold, limits the number of cavities available on the mold plate and lengthens the cycle time by having to actuate a slide to make the undercut. In addition, the closure itself has recesses which tend to fill with the viscous liquid product to be dispensed, providing a messy product. A similar problem of messiness exists with the product of the Wilson U.S. Pat. No. 4,220,248.

In Babiol U.S. Pat. No. 4,010,875 again two protrusions are used, increasing the cost to produce the mold, especially when large cavitation is required. Again an undercut is used on the lever on the pour half, increasing mold cost and lengthening cycle time. Again, projections and recesses in the resultant closure tend to provide a messy product in use.

The product of Susuki U.S. Pat. No. 3,752,371 requires manufacture using side core tools, here again increasing mold costs and cycle time. The product of Alpern U.S. Pat. No. 3,853,250 is a two-piece cap which must be assembled after molding, the assembly cost necessarily adding to the expense of the closure.

The closure of Cherneck U.S. Pat. No. 4,158,902 requires a split hinge which increases the likelihood of hinge breakage. Split hinges moreover have a space between the hinge sections which necessitates that the hinge sections are further out from the center line of the closure compared with a closure of similar size but having only a single hinge of the same length. A side thrust on the cap will have a greater torque action on the outside edge of the hinge because the force against the cap is multiplied by the distance of one hinge section from the other, whereas for a single hinge this distance is smaller and the resultant torque on the cap has less effect on the hinge. This cap also uses two levers, these actuating inside of the hinge sections; such a construction is very complex and requires very expensive molds.

Consequently, the art is in need of a reliable, inexpensive, splash-proof one-piece molded plastic dispensing closure particularly adapted for use with containers for dispensing viscous liquids.

SUMMARY OF THE INVENTION

Accordingly, it is an object of the present invention to overcome deficiencies in the prior art, such as indicated above.

It is a further object of the present invention to provide for the splash-proof dispensing of viscous liquids using an inexpensive, reliable, one-piece molded plastic dispensing closure.

It is another object of the present invention to provide an inexpensive, improved, splash-proof, one-piece molded plastic dispensing closure for use in conjunction with viscous liquid holding containers.

It is yet another object of the present invention to provide an improved splash-proof closure for use in conjunction with liquid holding containers having a minimum of internal projections and recesses into and on which viscous liquid may accumulate and possible solidify.

It is still another object of the present invention to provide a splash-proof closure eliminating the need for utilizing toggle-type or split hinges, and especially one in which the hinge is short and strong having no center hole (as required to pull out mold inserts in other closures).

It is still a further object of the present invention to provide a splash-proof closure of a one-piece moldable plastic structure.

It is yet a further object of the present invention to provide a splash-proof closure employing only one cap-stopping protrusion, and especially one having a cam surface for the protrusion which is part of the otherwise present structure of the closure requiring no additional tooling to produce.

Another object of the present invention is to provide a splash-proof closure employing a resilient and bendable cap-stopping protrusion which can be either round or flat with rounded edges, simple to produce and clean in use.

It is still another object of the present invention to provide a splash-proof closure which can be made inexpensively, in reduced time, simply and easily.

It is another object of the present invention to provide a splash-proof closure which can be produced from relatively simple and inexpensive molds, especially such a closure having no undercuts which are difficult and costly to manufacture.

Still other objects, features and attendant advantages of the present invention will become apparent to those skilled in the art from a reading of the following detailed description of embodiments constructed in accordance therewith, taken in conjunction with the accompanying drawings.

DESCRIPTION OF PREFERRED EMBODIMENT

Figure 1:
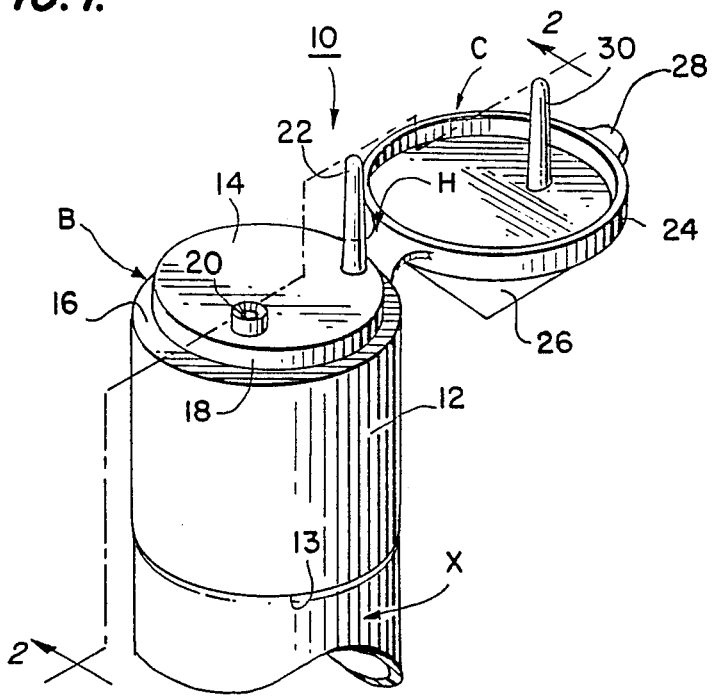
FIG. 1 is a perspective view of the splash-proof closure of the present invention, the closure shown as being mounted to a viscous liquid holding container partly broken away.

The presently preferred embodiment 10 of the present invention is illustrated in FIG. 1 of the drawings. The splash-proof closure 10 of the present invention comprises the combination of a body portion B and a cap portion C, both of which are integrally molded together in a one-piece structure via a hinge line H. The body portion B is threadably mounted to the mouth of e.g. a baby oil holding container X, although it will be understood that the splash-proof closure of the present invention can be utilized on any liquid holding container or receptacle, such as containers for holding oils, colognes, lubricants, liquid detergents and the like.

Figure 2:
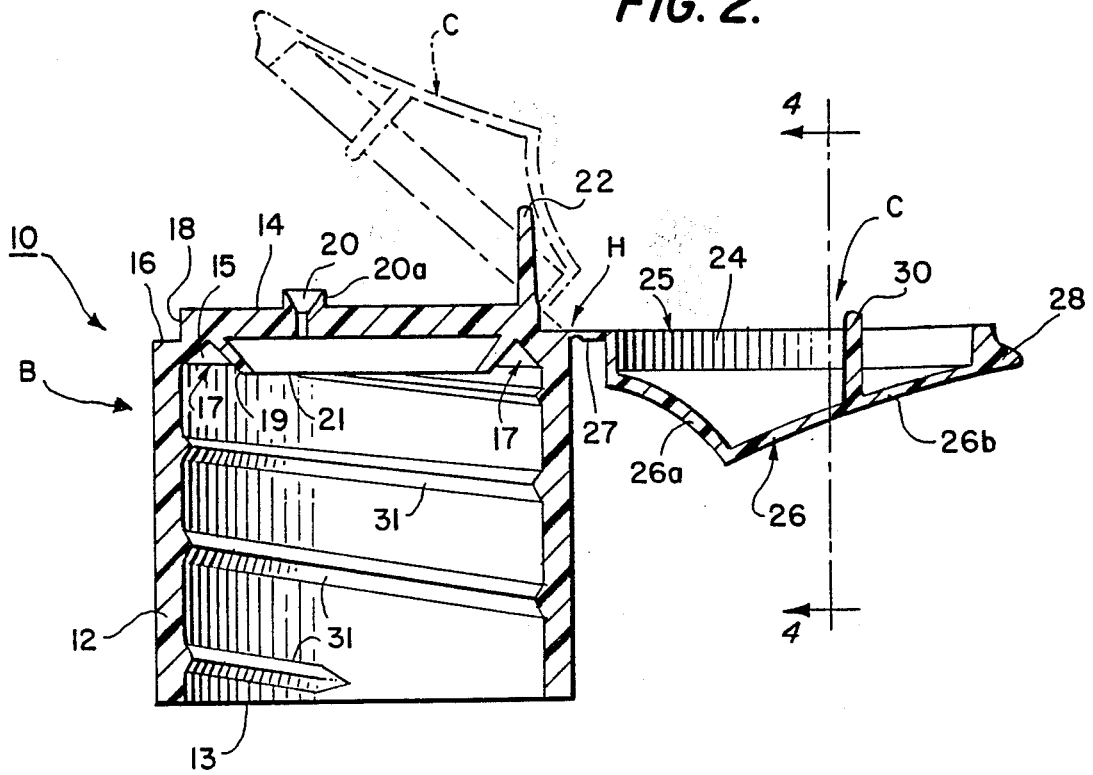
FIG. 2 is a cross-sectional view of the splash-proof closure of the present invention taken along line 2—2 in FIG. 1, illustrating the cap portion in an open position.

Referring now to FIGS. 1 and 2, the closure body portion B includes a substantially tubular skirt 12 having an open lower end 13 for receiving the neck portion of a container, and an integrally molded closed circular upper wall 14, the skirt 12 extending downwardly perpendicular from the upper wall 14 and generally having an internal circumference equal to that of the circumference of the upper wall 14. The skirt 12 includes an internal, integrally molded thread 31 for matingly engaging a corresponding thread provided on the neck portion of the container X. In the illustrated embodiment 10, the skirt wall 12 and upper wall 14 have the same thickness, although it should be understood that the individual wall thickness may vary in conjunction with different sized containers.

As best illustrated in FIG. 2, the region where the skirt wall 12 joins the upper wall 14 is provided with a substantially annular shoulder cut-away or recessed region including an annular horizontal surface 16 belonging to the upper skirt wall and an annular vertical surface 18 extending around the periphery of upper wall 14. In the illustrated embodiment 10, the vertical shoulder 18 has a height approximately equal to the thickness of upper wall 14, and likewise the horizontal shoulder 16 has a width approximately equal to the thickness of the skirt wall 12. The underneath side of the upper wall 14 may include an integrally formed conventional annular ring 19 for abutting against the container mouth, and which extends downwardly from wall 14, the annular ring 19 including an opening 21 for the passage of liquid therethrough. The annular ring 19 extends downwardly at an angle relative to the upper wall 14, preferably about 35°, has a circumference somewhat smaller than that of the skirt 12 to permit the abutment of the container mouth in the space 17 defined between the annular ring 19 and the skirt 12. Although not necessary, the space 17 between the skirt 12 and the annular ring 19 may include a 45° angled upper surface region 15 opposing the 45° angled surface of the annular ring 19.

The closure body portion B also is equipped, on its upper wall 14, with a generally circular dispensing aperture 20 which extends parallel to the longitudinal axis of the skirt. The aperture 20 permits the flow of liquid therethrough after having passed through the mouth of the container and the annular ring opening 21. Aperture 20 includes a funnel-shaped passage and is equipped with an integrally formed collar **20*a*, the aperture being located in the wall 14 approximately half-way between the center of the wall 14 and its peripheral edge 18** opposite a hinge H, described in more detail below.

Located on or near the peripheral edge 18 of the wall 14 and on a line passing through the dispensing aperture 20, the center of the upper wall 14 and the hinge H, is a flexible vertically erect and integrally formed protrusion or post 22, which cooperates with and pushes away or "stops" the cap thereby forming a splash proofing or preventing means. The protrusion 22 being of a resilient material, will spring into a substantially erect vertical position upon removal of the cap portion C, thus preventing the cap C from blocking the liquid outlet passages during the dispensing mode of the container. The post 22 should project vertically at a 90° angle relative to wall 14, and have a height typically equal to about four times the thickness of upper wall 14, it being understood that the precise height of the protrusion 22 will be determined in relation to the location of the dispensing aperture 20 to ensure that the protrusion 22 keeps the cap C out of the path of liquid being dispensed through the dispensing aperture 20. Although the post or protrusion 22 in the illustrated embodiment is shown to have a diameter which is roughly on the order of that of the liquid outlet aperture 20, it will be understood that these two have no relation to one another and that such post 22 can vary considerably in its cross sectional dimensions and configuration, e.g. it may also be flat with rounded edges.

The cap portion C includes a substantially circular wall 24 having an open bottom end 25 and a generally domed closed upper end 26. The height of the circular cap wall 24 should be slightly greater than the vertical height of the vertical annular shoulder 18 and a width approximately equal to that of the width of the horizontal annular shoulder 16. The inner diameter of the wall 24 of the cap C should be only slightly larger than the diameter of wall 14 so that it will tightly fit over the upper wall 14 and engage therewith. The exterior of the wall 24, opposite the hinged region H, includes an integrally molded finger-opening tab 28.

The domed region 26 of the cap C is provided with a vertically erect, downwardly extending, integrally formed closing post 30, which is adapted to be received within the aperture 20 of wall 14 when the cap is in its closed position (see FIG. 3) to effect closure of dispensing aperture 20 and assist in locking. The closing post 30 may desirably have a height approximately equal to one-half the height of the cap-stopping resilient post 22 and/or about twice the thickness of the upper wall 14, and a circumference slightly smaller, i.e. almost equal, to that of the aperture 20, so as to enable the snug mating of the post 30 when inserted within aperture 20, thereby sealing the container and the closure body portion B to the passage of liquid. The walls of the cap C may have a thickness approximately equal to two-thirds the thickness of the walls 12, 14, the relative thickness of the latter making them somewhat less flexible.

Figure 4:
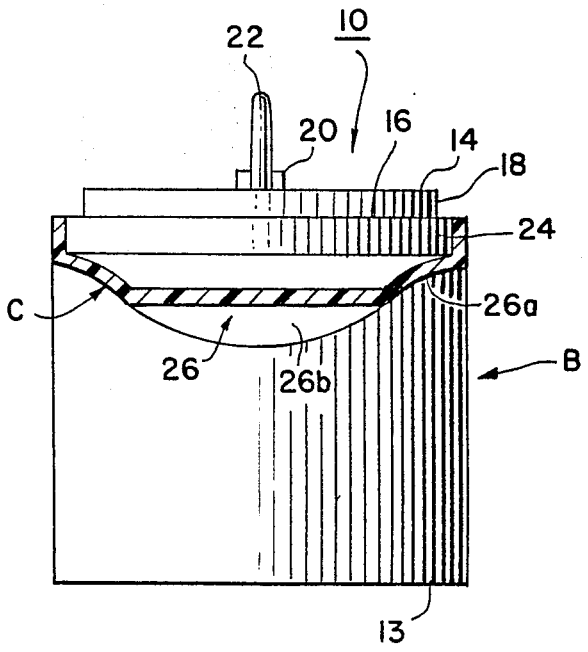
FIG. 4 is a cross-sectional view of the cap portion taken along line 4—4 in FIG. 2.

The dome region or closed upper wall 26 (also see FIG. 4) of the cap C includes a first curved wall **26*a* closer to the hinge H as seen in FIG. 2, and which is slanted at an angle of approximately 45° to that of wall 14, and a second somewhat slanted wall 26*b* extending from a peak or apex 26*c* toward the tab 28, and which is slanted at an angle of approximately 30° to that of wall 14. In the illustrated embodiment 10, the first curved wall 26*a* is approximately one-half the length of the slanted wall 26*b*, but of course these dimensions are variable in relation to the dimensions and location of the post 22 and the angle of inclination of the wall 26*a*, bearing in mind the function of the curved wall 26*a* to serve as cam for the post 22**.

Figure 3:
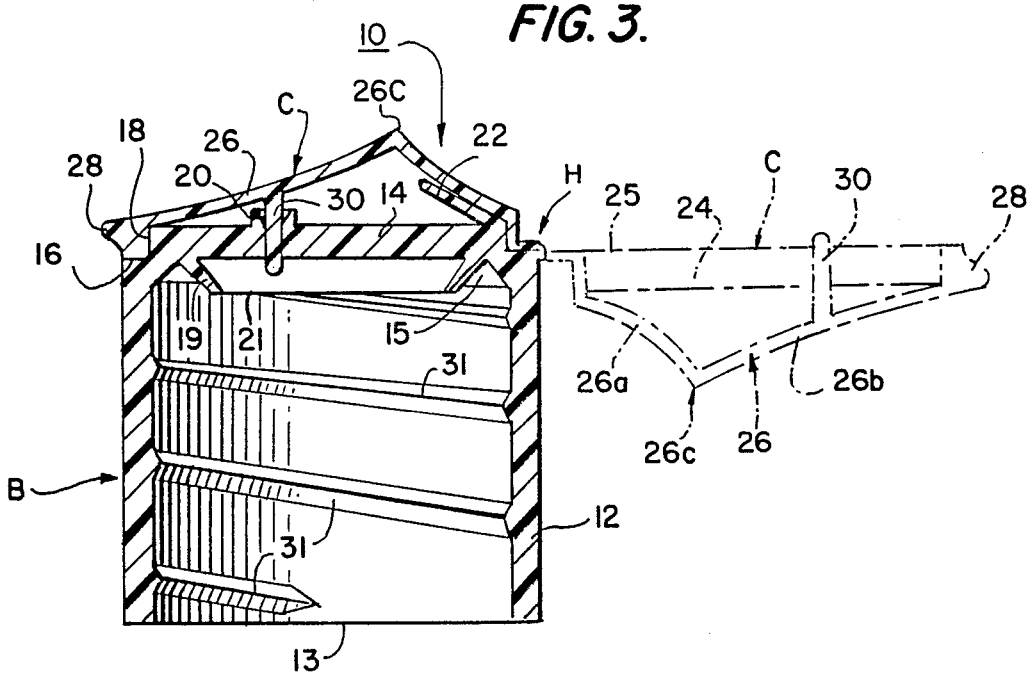
FIG. 3 is a cross-sectional view of the splash-proof closure of the present invention taken along line 2—2 in FIG. 1, illustrating the cap portion in the closed position.

As best shown in FIG. 3, upon closing the cap C on its body portion B, the 45° angled first slanted wall **26*a* acts as a cam to bend the cap-stopping resilient post 22 at a 45° angle relative to wall 14, in other words generally parallel to wall 26*a* when the cap C is in its closed position. It should be understood that while the cap C is in an open position (see FIG. 2), post 22 will prevent cap C (as shown in phantom) from moving towards the liquid discharge aperture 20. It should also be understood that the post 22 will only deform under conditions of applied force by the user when the cap C must be placed on its body portion B when it is desired to close the container and closure. It should further be understood that the apex 26*c* of the domed wall 26 must have an interior height slightly greater than that of the height of the cap-stopping post 22 as shown in FIG. 3**, otherwise the cap cannot be closed.

Figure 5:
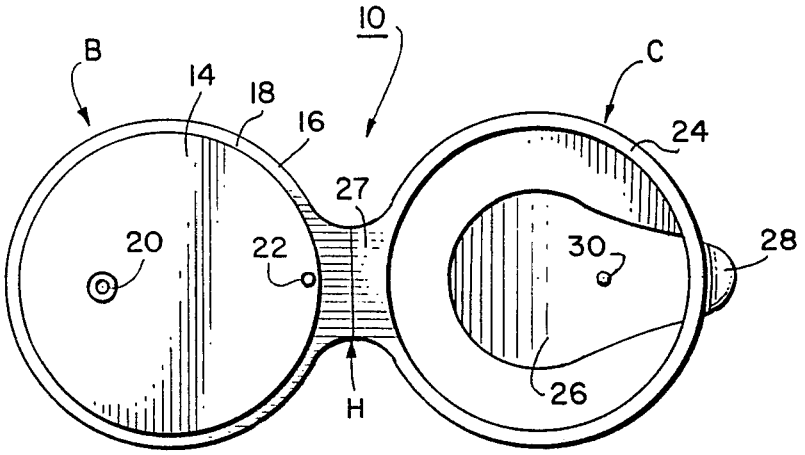
FIG. 5 is a plan view of the splash-proof closure of the present invention, showing the cap portion in an open position.

Referring now to FIGS. 2, 3 and 5, the hinge H connects or joins the cap C to the body B. The hinge H is essentially a materially thinned region molded in a known way between skirt 12 and cap wall 24, the hinge including a fold line generally tangent to the skirt 12 and circular cap wall 24, and generally in the same plane to that of the horizontal flange 16, and connected to the circular cap wall 24 by a flap 27. It should be understood that the hinge H is made from material placed tangentially outside the skirt 12 and the cap wall 24, so that upon closing the cap onto its body B, the hinge will fold over on itself, thereby allowing the post 22 to deform and the cap C to assume the closed position as shown in FIG. 3 with the post 30 within the aperture 20 and the flap 27 being seated on the horizontal shoulder 16.

Figure 6:
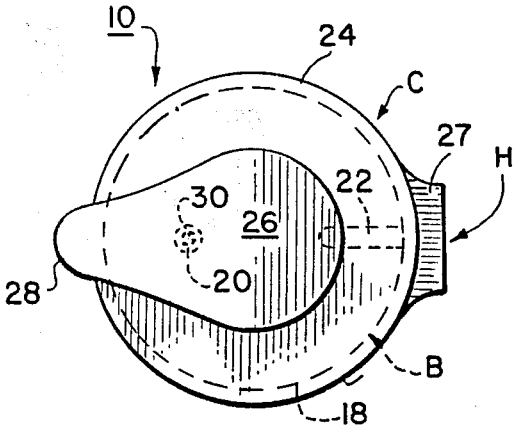
FIG. 6 is a plan view of the splash-proof closure of the present invention, illustrating the cap portion in a closed position.

Referring now to FIGS. 5 and 6, the finger tab 28, closing post 30, cap-stopping resilient post 22 and dispensing aperture 20 should all be positioned along a straight line passing perpendicular to the axis of the hinge H. The hinge H desirably has a length approximately equal to one-third the diameter of the circular wall 14 of the body portion, although other dimensions could be employed. It should be understood that the flap 27 may have varying widths, but should be wide enough to permit the cap C to fold over onto the body portion B. As mentioned above, the closure 10 is a one-piece molded plastic body, preferably formed by injection molding in a single mold of a 48, 60, 72 or 96 cavity mold plate. The closure should be formed of resilient plastic material, most particularly polypropylene, which has superior hinge properties.

The present closure is a significant improvement because of its simple effectiveness and because it can be manufactured at nominal cost using conventional straight pull injection molding dies to form the entire closure structure. Due to the simple structure of the closure of the present invention, manufacturing and capital costs are relatively low.

It will be obvious to those skilled in the art that various changes and modifications may be made without departing from the scope of the invention, and the invention is not to be considered limited to what is shown in the drawings and described in the specification.

What is claimed is:

1. A plastic closure, primarily useful in conjunction with viscous liquid holding containers, comprising:

a body portion including a tubular skirt having a longitudinal axis, an open bottom and a closed upper wall, said skirt having an internal periphery and an external periphery, said upper wall having an external diameter and including a top surface and a bottom surface, and a dispensing aperture extending through said upper wall, said tubular skirt forming an annular shoulder at its upper end extending about said upper wall;

a cap portion, integrally formed on said body portion, including a tubular wall having a central axis, an open bottom end and a closed domed upper wall having an apex, said tubular wall having an internal diameter slightly larger than the external diameter of said body portion upper wall to provide a tight mating fit therebetween, and the bottom end of said tubular wall being adapted to seat on said annular shoulder;

a hinge, located in a plane perpendicular to said axes, for integrally joining said cap portion to said body portion, and including a thinned hinge line between said cap portion and said body portion, for allowing said cap portion to rotate thereabout close on said body portion;

a cap-stopping resilient post, integrally formed on said skirt upper wall adjacent the peripheral edge of said upper wall and extending upwardly vertically and parallel to said longitudinal axis, for preventing the movement of said cap portion toward the dispensing aperture when the closure is uncapped;

cam means, integrally formed as part of and defined by a portion of said domed upper wall lying between said hinge and said apex, for bending said cap-stopping post to an approximately 45° angle relative to said skirt upper wall when said cap portion is closed on said body portion and for stopping against said cap-stopping resilient post when the closure is uncapped, said cam means being in a plane located approximately 45° above said skirt upper wall when said cap portion is closed on said body portion;

finger-tab means, integrally formed on said tubular wall located opposite said hinge to extend radially outwardly from said tubular wall in a plane perpendicular to said central axis, for providing a region to grasp said cap portion for movement on or off of said body portion; and closing post means, integrally formed on said domed upper wall in the region between said apex and said finger-tab means and extending vertically downwardly parallel to said axes, for reception within said dispensing aperture when the closure is capped; said closing post, the dispensing aperture, said cap-stopping resilient post, said cam means and said finger-tab means all lying along a line extending through and perpendicular to the axis of said hinge.

2. A closure in accordance with claim 1, wherein said bottom surface of said skirt upper wall further includes an integrally formed annular ring, the space between said annular ring and said skirt internal periphery defining a region for receiving the mouth of a container.

3. A closure in accordance with claim 1, wherein said internal periphery of said skirt further includes an internally threaded region.

4. A closure in accordance with claim 1, wherein said liquid outlet includes an internally formed funnel-like region.

5. A closure in accordance with claim 1, wherein said closure is molded in one piece.

6. A closure in accordance with claim 1, wherein said closure is formed of polypropylene.

7. A one-piece, polypropylene closure useful in conjunction with the dispensing of viscous liquids from viscous liquid holding containers, comprising a tubular body portion having an internally threaded surface for cooperation with the neck of a viscous liquid holding bottle, said tubular body portion having a closed upper wall with a dispensing aperture extending therethrough;

a cap portion integral and unitary with said body portion and separated therefrom by an integral hinge which permits said cap to rotate relative to said body portion approximately 180°;

a cap-stopping resilient post unitary and integral with the upper wall of said body portion and projecting upwardly therefrom near said hinge;

said cap portion having a closed upper wall including an inclined portion near said hinge, said inclined portion constituting splash-preventing means for stopping against said cap-stopping resilient post when the closure is uncapped to prevent inadvertent blocking of the dispensing aperture when the closure is uncapped; and closing post means integrally formed on the inner surface of the closed upper wall of said cap portion, said closing post means projecting downwardly into the dispensing aperture when the closure is capped; said closing post, the dispensing aperture, and said cap-stopping resilient post lying along a line extending through and perpendicular to the axis of said hinge.

8. A closure according to Claim 7 wherein said hinge has a single hinge line.

* * * * *